US006263601B1

(12) United States Patent
Emert

(10) Patent No.: US 6,263,601 B1
(45) Date of Patent: Jul. 24, 2001

(54) LIGHTED REAL ESTATE SIGN AND METHOD OF MARKETING REAL ESTATE

(76) Inventor: David Scot Emert, 3059 Brentmoor Dr., St. Charles, MO (US) 63303

( * ) Notice: Subject to any disclaimer, the term of this patent is extended or adjusted under 35 U.S.C. 154(b) by 0 days.

(21) Appl. No.: 09/187,129

(22) Filed: Nov. 5, 1998

Related U.S. Application Data

(60) Provisional application No. 60/075,565, filed on Feb. 23, 1998.

(51) Int. Cl.[7] ..... G09F 13/04

(52) U.S. Cl. ..... 40/564; 40/572; 40/606; 40/607; 40/610; 248/545; 248/551; 248/552; 248/156; 248/530; 292/281; 292/285; 70/58; 70/164

(58) Field of Search ..... 40/564, 572, 606, 40/607, 610; 248/156, 530, 545, 551, 552; 292/285, 286, 281; 70/58, 164, 234, 235

(56) References Cited

U.S. PATENT DOCUMENTS

| | | | | |
|---|---|---|---|---|
| 1,580,207 | * | 4/1926 | Kibbe | 248/552 |
| 1,893,653 | * | 1/1933 | Reininger | 40/545 |
| 2,188,419 | * | 1/1940 | Saviteer | 52/103 |
| 2,190,222 | * | 2/1940 | Strasser | 248/156 X |
| 2,538,118 | * | 1/1951 | Miller | 248/156 X |
| 2,558,944 | * | 7/1951 | Emmerson | 40/564 |
| 2,628,797 | * | 2/1953 | Campomar | 248/156 X |
| 2,647,718 | * | 8/1953 | Disera | 248/156 X |
| 3,673,413 | * | 6/1972 | Lee | 250/206 |
| 3,757,108 | * | 9/1973 | Burland | 240/46.59 |
| 3,947,985 | * | 4/1976 | Skrzypczak | 40/473 |
| 4,072,286 | * | 2/1978 | Foncannon | 248/156 X |
| 4,215,501 | * | 8/1980 | Meijer | 40/559 |
| 4,254,457 | | 3/1981 | Lordier . | |
| 4,373,284 | | 2/1983 | Crane . | |
| 4,387,522 | | 6/1983 | Sommers-Szoszky . | |
| 4,532,579 | | 7/1985 | Merryman . | |
| 4,593,872 | * | 6/1986 | Svensson | 248/156 |
| 4,843,525 | * | 6/1989 | Williams | 40/564 X |
| 4,843,746 | * | 7/1989 | DesNoyers et al. | 40/607 |
| 4,923,165 | * | 5/1990 | Cockman | 248/156 X |
| 4,989,126 | * | 1/1991 | Preuss | 40/564 X |
| 5,007,190 | * | 4/1991 | Shyu | 40/564 |
| 5,011,107 | * | 4/1991 | Reece | 248/156 X |
| 5,101,329 | * | 3/1992 | Doyle | 362/183 |
| 5,113,627 | * | 5/1992 | Jarrett, Sr. | 248/156 X |
| 5,123,623 | * | 6/1992 | McNamara | 248/156 X |
| 5,270,910 | * | 12/1993 | Kile | 40/564 X |
| 5,467,076 | | 11/1995 | Ruocco et al. . | |
| 5,664,851 | * | 9/1997 | Dunn | 40/312 X |
| 5,729,924 | | 3/1998 | Reading . | |
| 5,881,978 | * | 3/1999 | Rust | 40/607 X |
| 5,920,634 | * | 7/1999 | Chiquette | 381/124 |
| 6,003,255 | * | 12/1999 | Mahoney et al. | 40/606 |
| 6,004,002 | * | 12/1999 | Giannone | 362/183 |

FOREIGN PATENT DOCUMENTS

| | | | | |
|---|---|---|---|---|
| 2618814 | * | 2/1989 | (FR) | 40/606 |

* cited by examiner

*Primary Examiner*—Terry Lee Melius
*Assistant Examiner*—Andrea Chop
(74) *Attorney, Agent, or Firm*—Howell & Haferkamp, L.C.

(57) ABSTRACT

A lighted real estate sign having at least one translucent face with indicia to convey marketing information pertaining to a parcel of real estate. An internal light illuminates the translucent face and clearly displays the indicia at night. The sign is powered by a battery, and controlled by a control circuit in response to inputs from a solar panel used to recharge the battery, a photocell used to detect appropriate light conditions to illuminate the internal light, and a timer to turn off the light. The real estate sign is attached to a mounting bracket, which, in turn, is anchored to the parcel of real estate. The sign is locked to the mounting bracket to prevent theft and to rigidly maintain the sign and position.

17 Claims, 5 Drawing Sheets

LIGHTED REAL ESTATE SIGN AND METHOD OF MARKETING REAL ESTATE

This application claims the benefit of Provisional No. 60/075,565 filed Feb. 23, 1998.

BACKGROUND OF THE INVENTION

This invention relates to illuminated real estate signs and to methods of marketing real estate.

For quite some time, real estate signs have played a significant role in transferring interests in real property, whether by sale or lease. In front of homes and businesses all over the country, real estate signs notify the public that a given piece of property is available for sale, lease, or possibly other arrangements as real property owner(s) may desire. A fair amount of interest in properties is sparked when people for one reason or another happen to pass by and see a real estate sign located on the property. Indeed, simply driving around neighborhoods looking for real estate signs is a common way that people learn that a particular property is available for sale or lease.

Several different types of real estate signs exist in the marketplace. The signs themselves are typically metallic and are supported by metal or wood structures that are usually affixed to the front lawn of the property, or other suitable locations that are visible to the public. The signs themselves are often thin, rectangular panels overlaid with text and graphics capable of withstanding the elements. However, wood, plastic, and cardboard signs of lesser durability may also be found which serve the same purpose of notifying the public that the property is available for sale or lease. The structures supporting real estate signs are typically one of two basic constructions. First, a wooden cross arm structure from which the sign is suspended is common. A second type of structure incorporates metallic poles attached to each side of the real estate sign.

A disadvantage of real estate signs is that they are often difficult to read, and sometimes difficult to see at all, after dark. While a portion of the market of potential buyers and/or lessors has ample opportunity to locate and read real estate signs in daylight hours, an increasing portion of the market does not. Also, even if a real estate sign is noticed in the darkness, the darkness makes it difficult to read key information (e.g. phone numbers and real estate company names) on the signs. These difficulties may cause a potential buyer or lessor to refrain from viewing properties at night altogether and certainly impedes the progress of those that do. Therefore, an appreciable portion of the interested market may not get the opportunity to view properties because they could not easily find them at night.

One type of real estate signs has spot lights or flood lights in a cross arm that shine down upon a suspended display panel. The display panel is overlaid with information regarding marketing information about the property. The lights are located in the cross arm, along with other components, such as a battery, an alarm, a radio transmitter, a thermal sensor and/or heating coils to help ensure that the sign remains in place and remains visible at night to convey information about the property to potentially interested parties. While this type of sign provides a partial solution to the problems associated with viewing real estate properties at night, it is not without disadvantages.

For instance, the lighted real estate signs of this type may blend in with a multitude of lights in a neighborhood so that it becomes easy to miss unless one is carefully looking for it. For instance, porch lights, yard lights, street lights, and light coming through windows may make the sign difficult to see and read from certain vantage points where the surrounding light field backlights the sign and camouflages it. Also, when lit, the sign is practically invisible when viewed from a side perspective. Because of the relative thinness of the display panel, the silhouette of the sign may be made out only when one stands at a sufficient angle relative to the front or back faces of a sign. In other words, even though the lights shine down upon the face of the sign at night, the sign may nonetheless be virtually invisible from the side. Thus, it is possible that one could drive by this type of sign at night and completely miss it if the sign is approached from certain angles and/or a distracted driver or passenger briefly glances at the property only from a perspective in which the sign cannot be seen. Finally, the harsh bright light of this type of sign is prone to glare, and may be unwelcomed by the neighbors.

SUMMARY OF THE INVENTION

Among the several advantages of the present invention may be noted the provision of a lighted real estate sign that may be clearly seen against the backdrop of a lighted neighborhood at night; the provision of a lighted real estate sign that may be clearly noticed from any perspective around the sides of the sign; the provision of a lighted real estate sign that is less prone to glare; the provision of a lighted real estate sign having a soft, soothing glowing light; and a provision of a method of using such a sign at night to advertise a parcel of real estate as being available for sale or lease.

Generally, the lighted real estate sign of the present invention has an anchor that may be secured to a parcel of real estate. A sign assembly having a translucent face is connected to the anchor. Inside the sign assembly is an internal light source that illuminates the translucent face after dark. A lock assembly secures the sign assembly to the anchor in a manner that prevents detachment of the sign assembly from the anchor as well as the removal of the anchor from the real estate.

In another aspect of the invention, a method of marketing a parcel of real estate at night to advertise its availability for sale or lease is provided. A sign assembly having an internal light to illuminate a translucent face of the assembly is acquired. The translucent face of the sign assembly features indicia to convey marketing information pertaining the parcel of real estate. Anchoring the sign assembly to the parcel of real estate and energizing the internal light of the sign assembly completes the method, and the indicia on the translucent face of the sign assembly is clearly illuminated at night for all to see.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
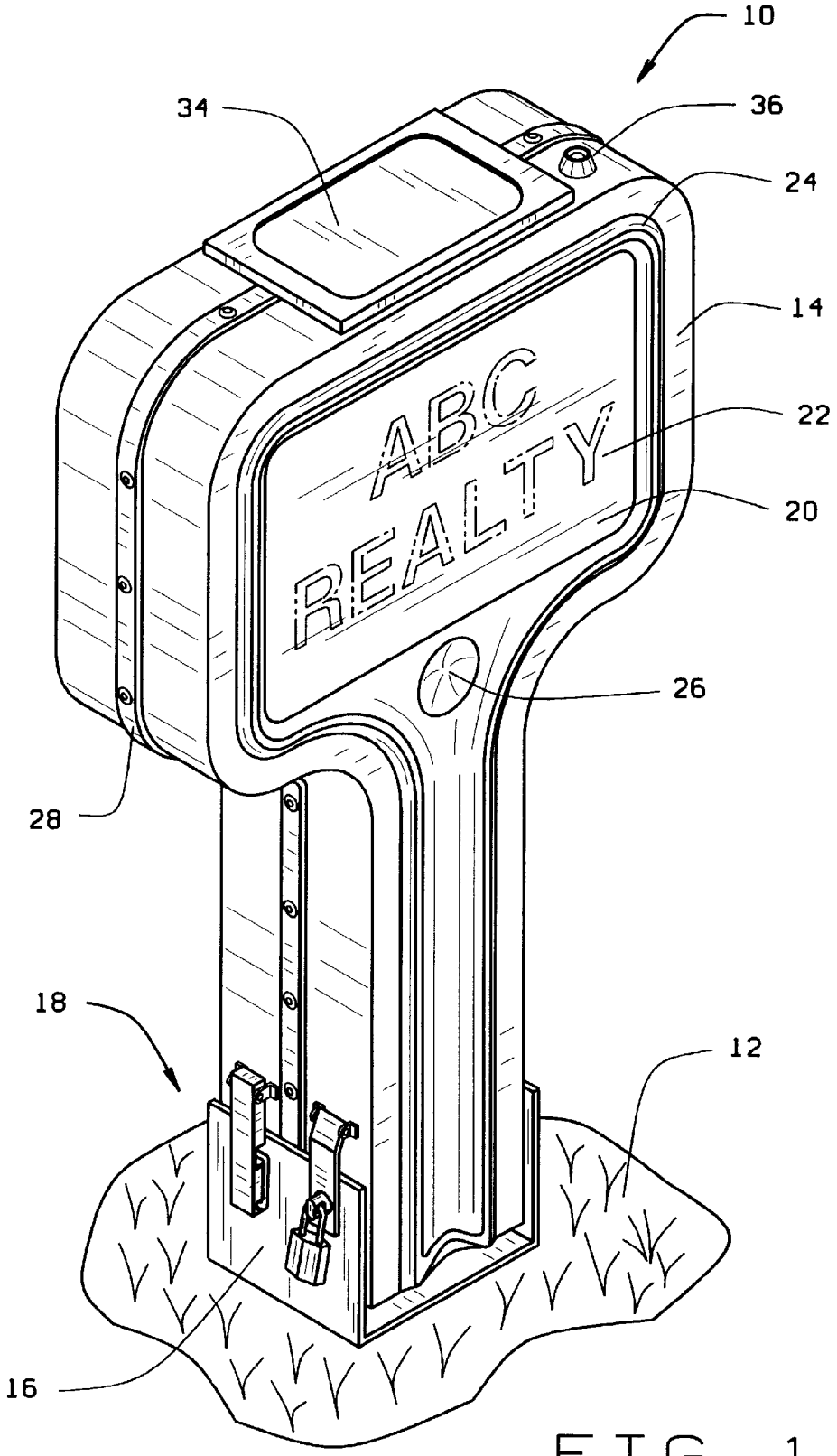
FIG. 1 is a perspective view of a real estate sign of the present invention.

Referring now to the drawings, a lighted real estate sign according to the present invention is indicated generally by the reference numeral 10 in FIG. 1. As explained more fully below, the sign 10 is adapted to be anchored to a parcel of real estate 12 and to conspicuously advertise the availability of the real estate 12 for sale or lease both during daylight hours and well into the night. The basic shape and contours of the lighted real estate sign shown and described herein is for illustrative purposes only. While the illustration herein is uniquely shaped and contoured to grab the attention of passers-by, the variety of appearances that the invention could assume is limited only by one's imagination. Of course, the invention could also easily be practiced in the form of a more traditional real estate sign.

Generally, the lighted real estate sign 10 of the present invention comprises a sign assembly 14, a mounting bracket 16 anchored to the real estate 12 as further described below, and a locking assembly generally designated by the reference numeral 18, also described in detail below.

The sign assembly is made of a sturdy weather-resistant polymeric resinous material, such as that sold under the LEXAN trademark by General Electric Company. Preferably, the entire sign assembly is translucent, although this is not essential. A translucent face 20, however, is an essential feature of the sign assembly 14. The translucent face 20 includes indicia, such as that indicated by reference numeral 22, to convey marketing information regarding the availability of a parcel of real estate 12. Preferably, the sign assembly and the translucent face are of a light color (e.g. white) and the indicia is of a darker color to provide maximum contrast when the sign is lit. However, any color combination may be used, including a dark sign assembly 14, a dark translucent face 20 and brightly colored indicia 22. Also, the contours 24 may be colored or decorated as desired to customize the appearance of the sign, and other features such as the convex circular surface 26, which the inventor reserves for his trademark, may be incorporated into the invention to alter its appearance.

Preferably, the sign assembly 14 is of a two-piece construction joined together at a seam 28 according to methods well known in the art. Preferably, the pieces of the sign assembly 14 are substantially identical to maintain a consistent appearance of the sign from both the front and the rear views. Also, the indicia 22 on the translucent face 20 is preferably the same on both pieces of the sign assembly 14. However, in certain situations it may be advantageous to use different indicia 22 on the faces of the sign, or even to vary the characteristics and location of the translucent face 20 so that each side of the lighted real estate sign has a distinct impression on a viewer.

Figure 2:
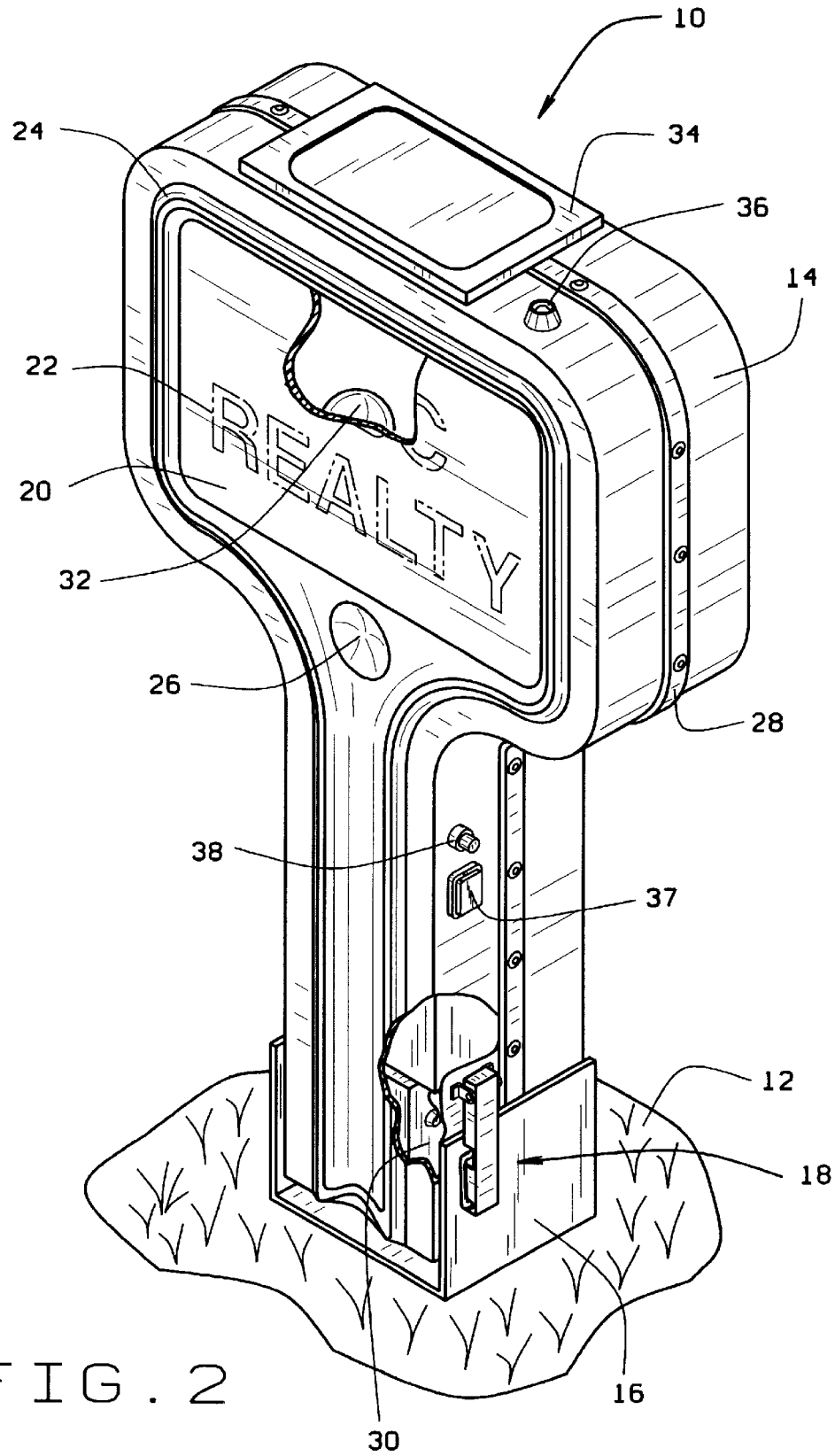
FIG. 2 is another perspective view of the real estate sign of FIG. 1, partially broken away to reveal the internal components of the sign.

Referring now to FIG. 2, the sign assembly 14 has an internal rechargeable battery 30 to power an internal light source 32. When the light is energized, it illuminates the translucent face 20 from within and thus clearly displays the indicia 22 after dark. Because the real estate sign 10 is illuminated from within, the translucent face takes on a soft, glowing appearance pleasing to the eye, unconducive to glare, and unlikely to blend into the surroundings of the sign. As the sign assembly 14 is made of a translucent material, the sides of the sign are fully lit and attractive to the eye as well so that the presence of the sign may be easily detected from all perspectives within a reasonable viewing distance.

Preferably the light source 32 is a neon bulb to uniformly illuminate the translucent face 20, although other types of lights may suffice without departing from the scope of the invention. It is to be appreciated that multiple neon bulbs could alternatively be used to produce different effects, and bulbs of different colors may be employed to change the appearance of the sign 10.

The sign assembly 14 also preferably includes a solar cell 34 that recharges the battery 30 during daylight hours. The operation of the solar panel may be controlled with a photocell 36, which may also serve to trigger the illumination of the sign at dusk. A switch 36 is provided on the exterior of the sign assembly 14 so that one may turn the sign control system on after installation, and turn the system off for storage or transport. Also, the intensity or brightness of the light 32 may be adjusted manually by an optional knob 32. The intensity of the light could also be monitored with the control circuitry, further described below.

Figure 3:
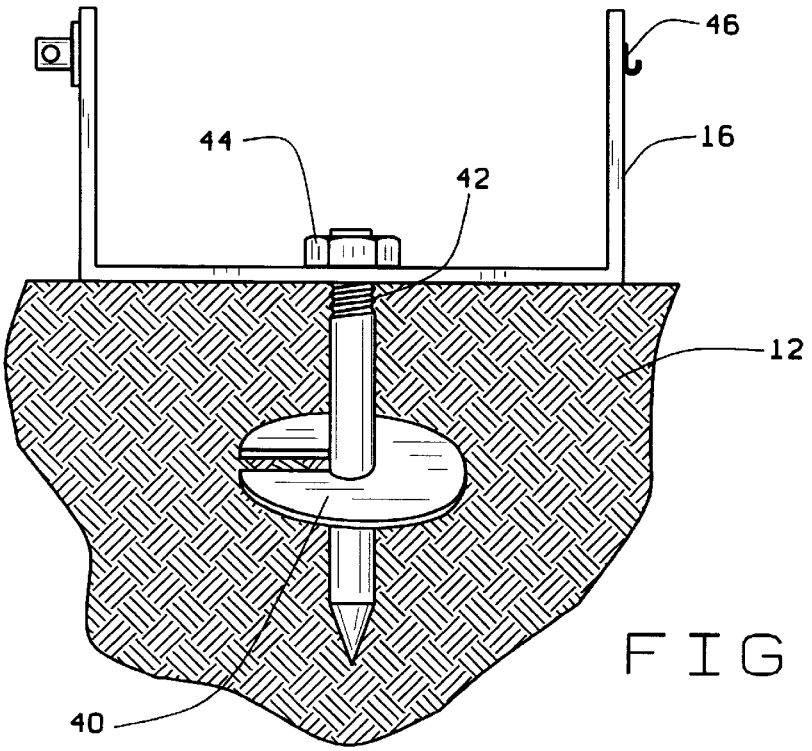
FIG. 3 is an elevational view of a mounting bracket of the real estate sign of FIG. 1 secured to the ground with an anchor.

FIG. 3 illustrates the anchoring assembly according to the present invention. An anchor 40 in the form of an auger is driven a sufficient distance into the ground of the real estate 12 to provide a firm anchor for the lighted real estate sign 10. The anchor 40 has a shaft portion 42 that extends above the surface of the real estate 12. The mounting bracket 16 is fitted over the shaft portion 42, and a nut 44 firmly connects the mounting bracket 16 to the extending shaft 42, thereby anchoring the mounting bracket 16 to the parcel of real estate 12. While the nut 44 prevents the mounting bracket from being removed from the anchor 40, it does not prevent the mounting bracket 16 from rotating about the anchor 40 along surface of the real estate 12. In this fashion, the real estate sign 10 may be pivoted about the anchor 40 after it is installed while the anchor remains stationary in the ground. When the sign assembly 14 is locked to the mounting bracket 16 with the locking assembly 18, the sign assembly cannot readily be detached from the anchor. To remove the anchor 40 from the real estate 12, the sign assembly 14 is detached from the mounting bracket 16, the nut 44 is removed, and the anchor 40 is unearthed. With this configuration, theft of the sign 10 is impaired.

Figure 5:
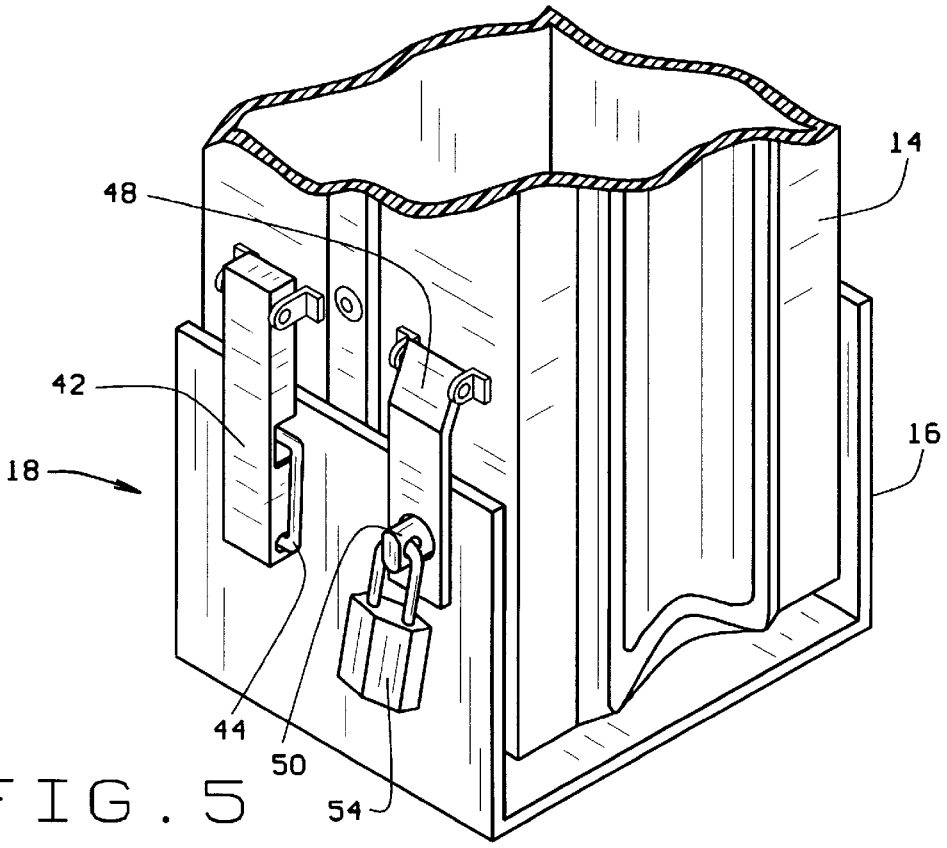
FIG. 5 is a fragmented perspective view showing the sign of FIG. 4 secured to the mounting bracket.
Figure 4:
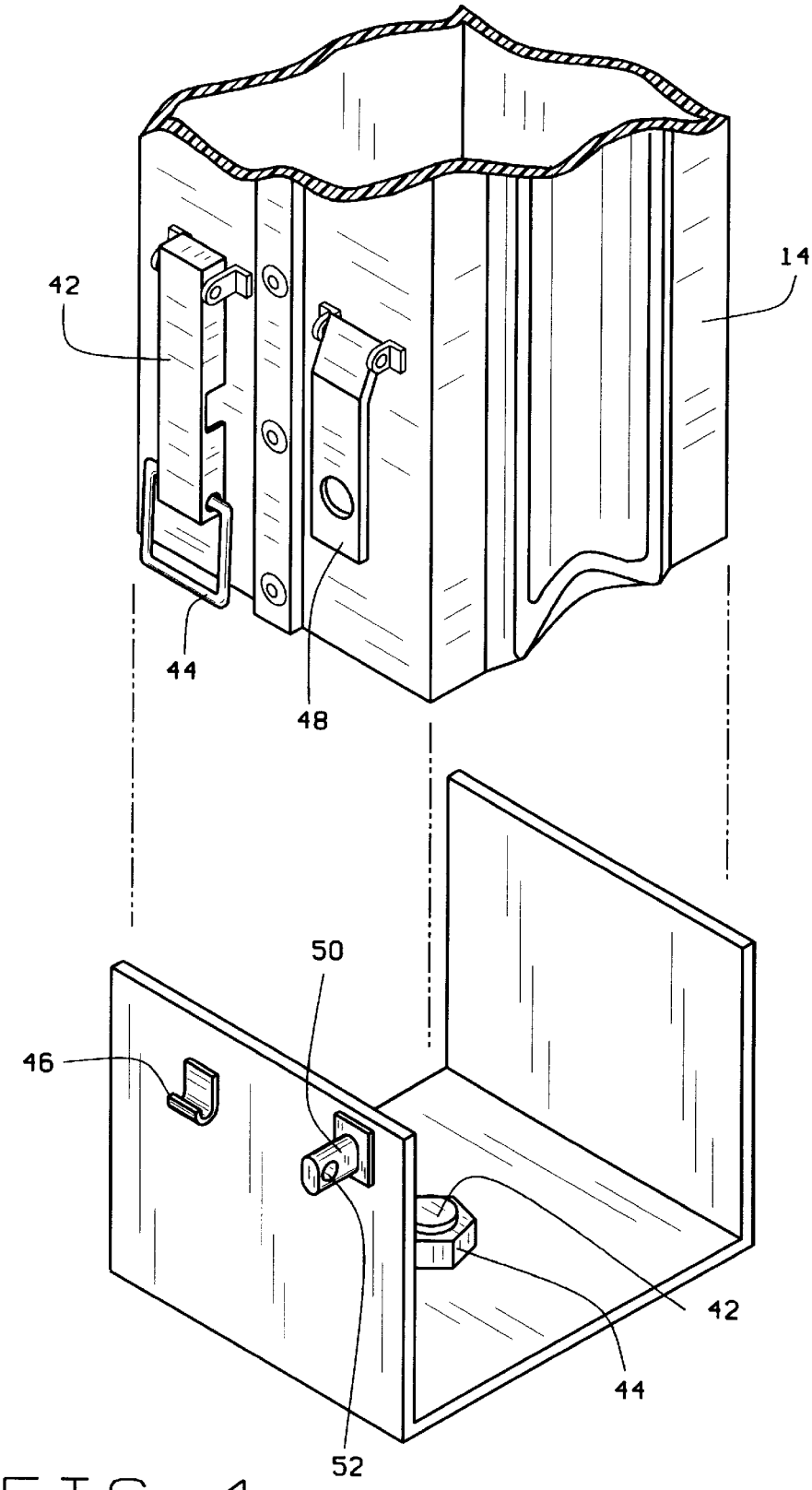
FIG. 4 is an exploded fragmented perspective view of the sign mounting bracket of FIGS. 1–3.

The locking assembly 18 that secures the sign assembly 14 to the mounting bracket 16 is best seen in FIGS. 4 and 5. The mounting bracket 16 is dimensioned to snuggly fit the bottom portion of the sign assembly 14. A hole in the bottom of the sign assembly accommodates the nut 44 that secures the mounting bracket 16 to the anchor 40. Once the sign assembly 14 is inserted into the mounting bracket 16 the sign assembly is attached to the mounting bracket with clasps 42 on either side of the sign assembly. The buckle 44 of a clasp is received by a tongue 46 on the mounting bracket 16 when the clasp 42 is placed at an angle relative to the sides of the sign assembly 14 and the mounting bracket 16. As the clasp 42 is closed, the buckle 44 is placed in tension as it rotates about the bottom of the clasp, thereby pulling the sign assembly 14 and the mounting bracket 16 firmly together. When the clasps 42 on each side of the sign assembly 14 are closed in such a manner, the sign assembly is sturdily maintained in an upright position inside the mounting bracket 16 and over the top of the anchor 40.

Once the clasps 42 are closed, the lockable latch 48 attached to one of the sides of the sign assembly 14 slips over a locking pin 50 attached to a corresponding side of the mounting bracket 16. A padlock 54 is then inserted through an aperture 52 in the locking pin 50 and closed, thereby locking the sign assembly 14 to the mounting bracket 16. As noted above, the connection between the mounting bracket 16 and the anchor 40 prevents the lighted real estate sign 10 from being removed from the ground when the locking assembly 18 engages the sign assembly 14 and secures it to the mounting bracket 16. While the above-described locking assembly 18 is preferred, it is recognized that many alternative lock assemblies are available to one of ordinary skill in the art to accomplish a secure connection between the sign assembly 14 and the mounting bracket 16.

Figure 6:
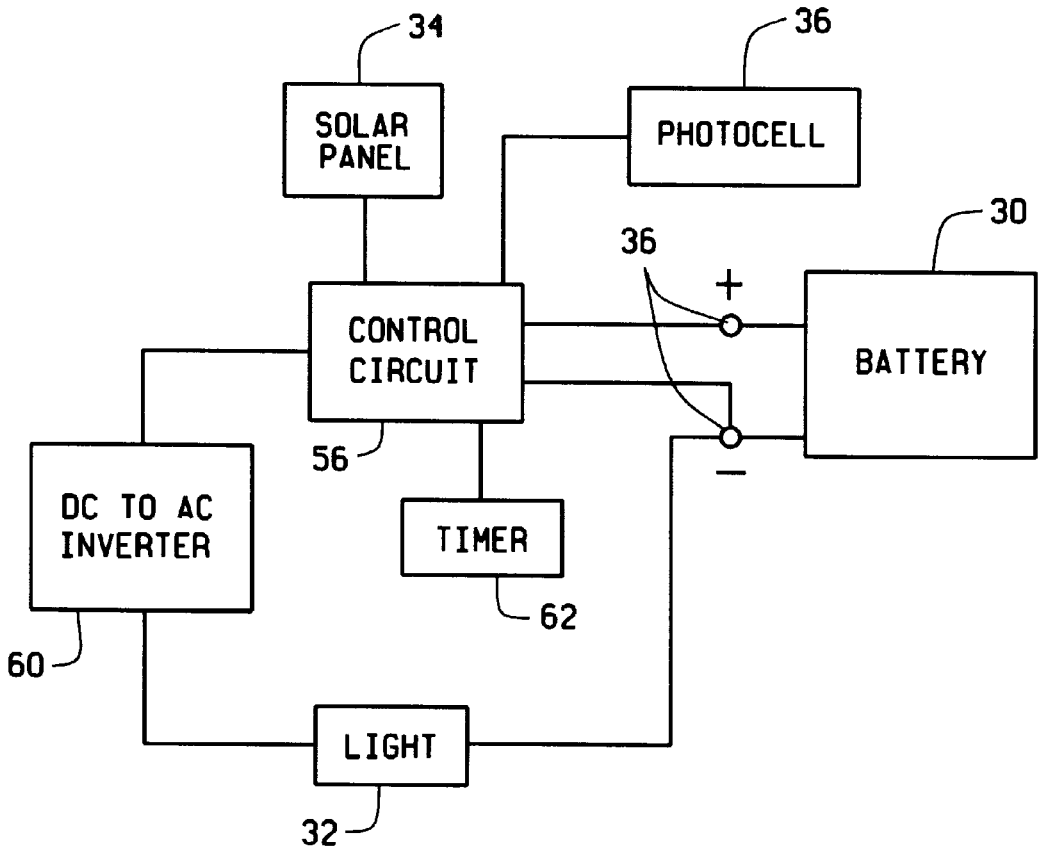
FIG. 6 is a schematic diagram showing the elements used to control illumination of the sign of FIG. 1.

A schematic of the control system for the internal components of the lighted real estate sign 10 is seen in FIG. 6. The switch 36 closes the circuit and places the battery 30 in operational connection with a control circuit 56 that drives and monitors the various operational components of the sign. It is recognized that the control circuit 56 could be constructed in many different ways and embody many different forms yet still accomplish the same basic functions as the customized circuitry developed by the inventor.

Using inputs on the circuit board the battery 30, the internal light 32 of the sign assembly 14, the solar panel 34, and the photocell 36 are interfaced with the control circuit 56. Because a neon bulb is used for the light source 32, a DC to AC converter 60 is provided to drive the neon bulb.

Briefly, the control system operates as follows. The switch 36 completes the circuit, allowing the control circuit 56 to be powered by the battery 30. During daylight hours, the control circuit operatively connects the solar panel to the battery for recharging. At a predetermined light setting, the photocell 36 triggers the control circuit to energize the light 32 through the DC to AC converter 60. Therefore, once the sign 10 is installed, the lighted real estate sign 10 will automatically illuminate the translucent face 20 as the daylight recedes. In order to prevent a complete discharge of the battery 30 and to minimize attention to the sign is as desired, such as late at night, the control circuit may de-energize the light source 32 in response to a timer element 62, which may or may not be integral with the control circuit 56. As the timer element 62 is adjustable to user preference, the real estate sign may be de-energized as desired. For instance, the system may be set to turn the light 32 off at a designated time each evening, or it may be set so that the light is energized for a specific duration after the photo cell 36 triggers the system.

While a rechargeable battery is preferred in the present invention for obvious reasons, the control system could be powered by a non-rechargeable battery, or alternatively by direct connection to a 120 volt alternating current power source. Likewise, the solar panel 34 could be replaced by a standard charging port for connection to a power source to recharge the battery.

While the present invention has been described by reference to a specific embodiment it should be understood that modifications and variations as would be apparent to one of ordinary skill in the art are within the scope of the invention which is limited solely by the claims and their equivalents.

What is claimed is:

1. A lighted real estate sign, comprising:

an anchor securable to a parcel of real estate;

a sign assembly connected to the anchor, the sign assembly having at least one translucent face and an internal light source to illuminate the translucent face; and a lock assembly having a plurality of parts directly connected to one another for securely fixing the sign assembly to the anchor in a manner for preventing removal of the sign assembly from the anchor to hinder removal of the anchor from the real estate;

the anchor comprising an auger having an extended shaft portion adapted to protrude from the ground when the auger is fully bored into the parcel of real estate, and a mounting bracket configured for attachment to the sign assembly and adapted for attachment to the extended shaft portion of the auger in a manner to allow the mounting bracket to rotate relative to the auger without moving the auger, the lock assembly being adapted to secure the sign assembly to the mounting bracket in a manner to inhibit separation of the auger from the mounting bracket and so that the real estate sign is capable of pivoting about the shaft portion of the auger when the real estate sign is locked to the mounting bracket.

2. The real estate sign of claim 1 wherein the sign assembly has a translucent surface encircling the light source, the translucent face being a portion of the surface.

3. The real estate sign of claim 2 wherein the at least one translucent face is made of a polymeric resinous material.

4. The real estate sign of claim 1 wherein the sign assembly has an internal battery operatively connected to the light source for powering the light source.

5. The real estate sign of claim 4 wherein the battery is rechargeable, the real estate sign further comprising a solar panel operatively connected to the sign assembly, the solar panel being operatively coupled to the battery in a manner to recharge the battery.

6. The real estate sign of claim 5 further comprising a photocell operatively connected to the battery.

7. The real estate sign of claim 6 further comprising a timer element and an internal control circuit, the control circuit operatively connecting the solar panel, the battery and the photocell, the control circuit being adapted for switching the internal light source on in response to an input from the photocell and for switching the internal light source off in response to an input from the timer element.

8. The real estate sign of claim 4 wherein the light source comprises a neon bulb.

9. The real estate sign of claim 8 further comprising a DC to AC inverter operatively connected to the battery and to the neon bulb for driving the neon bulb.

10. The real estate sign of claim 1 wherein the lock assembly comprises a first part securely fastened to the sign assembly, a second part securely fastened to the anchor, and a lock member for securely fixing the first part to the second part in a manner for preventing separation of the first part from the second part, the first and second parts and lock member being directly connected to one another.

11. The real estate sign of claim 10 wherein the lock member comprises a padlock.

12. A method of marketing a parcel of real estate at night to advertise the real estate as being available for sale or lease, the method comprising:

providing a sign assembly having a translucent front face, a translucent back face, translucent sides extending between the front and back faces, and an internal light being encircled by the faces and sides, the internal light being adapted and positioned to transmit light energy through the faces and sides, the translucent front face having indicia to convey marketing information pertaining to the parcel of real estate, the marketing information indicating that the real estate is available for sale or lease;

anchoring the sign assembly to the parcel of real estate; and energizing the internal light of the sign assembly in a manner so that light energy from the internal light is transmitted through the translucent front and back faces and through the translucent sides, thereby illuminating the sign to clearly display the indicia at night.

13. The method of claim 12 wherein the step of anchoring the sign assembly to the parcel of real estate comprises:

anchoring the mounting bracket to the parcel of real estate; and attaching the sign assembly to the mounting bracket.

14. The method of claim 13 further comprising locking the sign assembly to the mounting bracket with a pad lock.

15. The method of claim 12 wherein the step of energizing the internal light comprises:

providing a rechargeable battery and a control circuit;

operatively connecting the battery and the light to the control circuit; and controlling the energization of the light with the control circuit.

16. The method of claim 15 further comprising:

providing a solar panel to recharge the battery; operatively connecting the solar panel to the control circuit; and controlling recharging of the battery with the control circuit.

17. The method of claim 12 wherein the translucent back face has indicia to convey marketing information pertaining to the parcel of real estate, the marketing information on the translucent back face indicating that the real estate is available for sale or lease.

* * * * *